US008397687B2

(12) United States Patent
Lichti

(10) Patent No.: US 8,397,687 B2
(45) Date of Patent: Mar. 19, 2013

(54) AXIALLY COMPACT CAMSHAFT PHASER

(75) Inventor: Thomas Howard Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 338 days.

(21) Appl. No.: 12/912,338

(22) Filed: Oct. 26, 2010

(65) Prior Publication Data

US 2012/0097122 A1 Apr. 26, 2012

(51) Int. Cl.
*F01L 1/34* (2006.01)

(52) U.S. Cl. ..... 123/90.17; 123/90.31; 123/90.15

(58) Field of Classification Search ..... 123/90.15, 123/90.17, 90.31
See application file for complete search history.

(56) References Cited

U.S. PATENT DOCUMENTS 5,119,691 A 6/1992 Lichti et al.
6,363,896 B1 * 4/2002 Speier ..... 123/90.17
7,025,023 B2 4/2006 Lehmann et al.

FOREIGN PATENT DOCUMENTS

DE 10 2008 057 491 5/2010

* cited by examiner

*Primary Examiner* — Zelalem Eshete
(74) *Attorney, Agent, or Firm* — Thomas N. Twomey

(57) ABSTRACT

A camshaft phaser is provided for varying the phase relationship between a crankshaft and a camshaft in an internal combustion engine. The camshaft phaser includes a stator having a plurality of lobes. A rotor is disposed within the stator and includes a plurality of vanes interspersed with the stator lobes to define alternating advance and retard chambers. A bushing adaptor of the camshaft phaser is disposable axially within a pocket of the camshaft and is disposed axially within the rotor. The bushing adaptor defines at least in part a supply passage for communicating pressurized oil from the internal combustion engine to a control valve, an advance passage for selectively communicating pressurized oil from the control valve to the advance chambers, and a retard passage for selectively communicating pressurized oil from the control valve to the retard chambers.

16 Claims, 15 Drawing Sheets

AXIALLY COMPACT CAMSHAFT PHASER

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser, and more particularly to a vane-type camshaft phaser which includes a bushing adaptor and centrally located oil control valve for routing oil to and from the camshaft phaser.

BACKGROUND OF INVENTION

A typical vane-type camshaft phaser generally comprises a plurality of outwardly-extending vanes on a rotor interspersed with a plurality of inwardly-extending lobes on a stator, forming alternating advance and retard chambers between the vanes and lobes. Engine oil may be supplied to and from the camshaft phaser via a series of axial passages, and annular grooves cut on the inner diameter of the rotor. One groove is needed to supply oil to and from the advance chambers and one groove is needed to supply oil to and from the retard chambers. If the camshaft phaser includes an intermediate lock pin, an additional groove is needed to operate the intermediate lock pin. An additional groove is also needed if the camshaft phaser employs a centrally located oil control valve in order to supply oil thereto. Typically packaging more than two grooves in the rotor requires the rotor to be thicker than desired which undesirably increases the axial length of the camshaft phaser. Alternatively, packaging more that two grooves in the rotor without increasing the thickness of the rotor requires that the grooves be made narrower than desired which may lead to undesirable operation of the camshaft phaser, for example, slow operation thereof due to decreased oil flow capability. An additional factor that reduces the space available for the grooves in the rotor is that the camshaft is typically inserted axially into the rotor in order to locate the camshaft phaser coaxial with the camshaft. Another factor that reduces the space available for grooves in the rotor is that the camshaft phaser often includes a bias spring that extends axially into the rotor in order to bias the rotor into a default position when the internal combustion engine is not running.

German patent application publication number DE 10 2008 057 491 A1 discloses a camshaft phaser attached to a camshaft. The camshaft phaser includes a bushing between the rotor and camshaft phaser attachment bolt to partly define oil passages. However, the oil passages in the bushing require the bushing to be undesirably thick in order to accommodate both annular grooves and axial passages formed therein. Another drawback is that the bushing is clamped between the rotor and the camshaft and therefore must therefore be a part of the load path when transmitting camshaft torque.

What is needed is an axially compact camshaft phaser. What is also needed is such an axially compact camshaft phaser which does not compromise the size of oil passages used for communicating oil.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and connectable to the crankshaft of the internal combustion engine to provide a fixed ratio of rotation between the stator and the crankshaft. The camshaft phaser also includes a rotor coaxially disposed within the stator and having a plurality of vanes interspersed with the stator lobes defining alternating advance chambers and retard chambers. The advance chambers receive pressurized oil in order to change the phase relationship between the crankshaft and the camshaft in the advance direction while the retard chambers receive pressurized oil in order to change the phase relationship between the camshaft and the crankshaft in the retard direction. The rotor is attachable to the camshaft of the internal combustion engine to prevent relative rotation between the rotor and the camshaft. A bushing adaptor is coaxially disposable within a pocket of the camshaft and coaxially disposed coaxially within the rotor. A camshaft phaser attachment bolt extends axially through the bushing adaptor in a close fitting relationship and threadably engageable into the camshaft to attach the camshaft phaser to the camshaft. The bushing adaptor defines at least in part a supply passage for communicating pressurized oil from the internal combustion engine to a control valve, the supply passage being defined at least in part by a first annular groove formed on the inside surface defining the inside diameter of the bushing adapter. The bushing adapter also defines at least in part an advance passage for selectively communicating pressurized oil from the control valve to the advance chambers. The bushing adaptor also defines at least in part a retard passage for selectively communicating pressurized oil from the control valve to the retard chambers.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which:

FIG. 2B' is an enlarged view of the pertinent elements of FIG. 2B without reference numbers to clearly shown the oil flow through the camshaft phaser;

FIG. 2C' is an enlarged view of the pertinent elements of FIG. 2C without reference numbers to clearly shown the oil flow through the camshaft phaser;

FIG. 7B' is an enlarged view of the pertinent elements of FIG. 7B without reference numbers to clearly shown the oil flow through the camshaft phaser;

FIG. 7C' is an enlarged view of the pertinent elements of FIG. 7C without reference numbers to clearly shown the oil flow through the camshaft phaser;

DETAILED DESCRIPTION OF INVENTION

Figure 1:
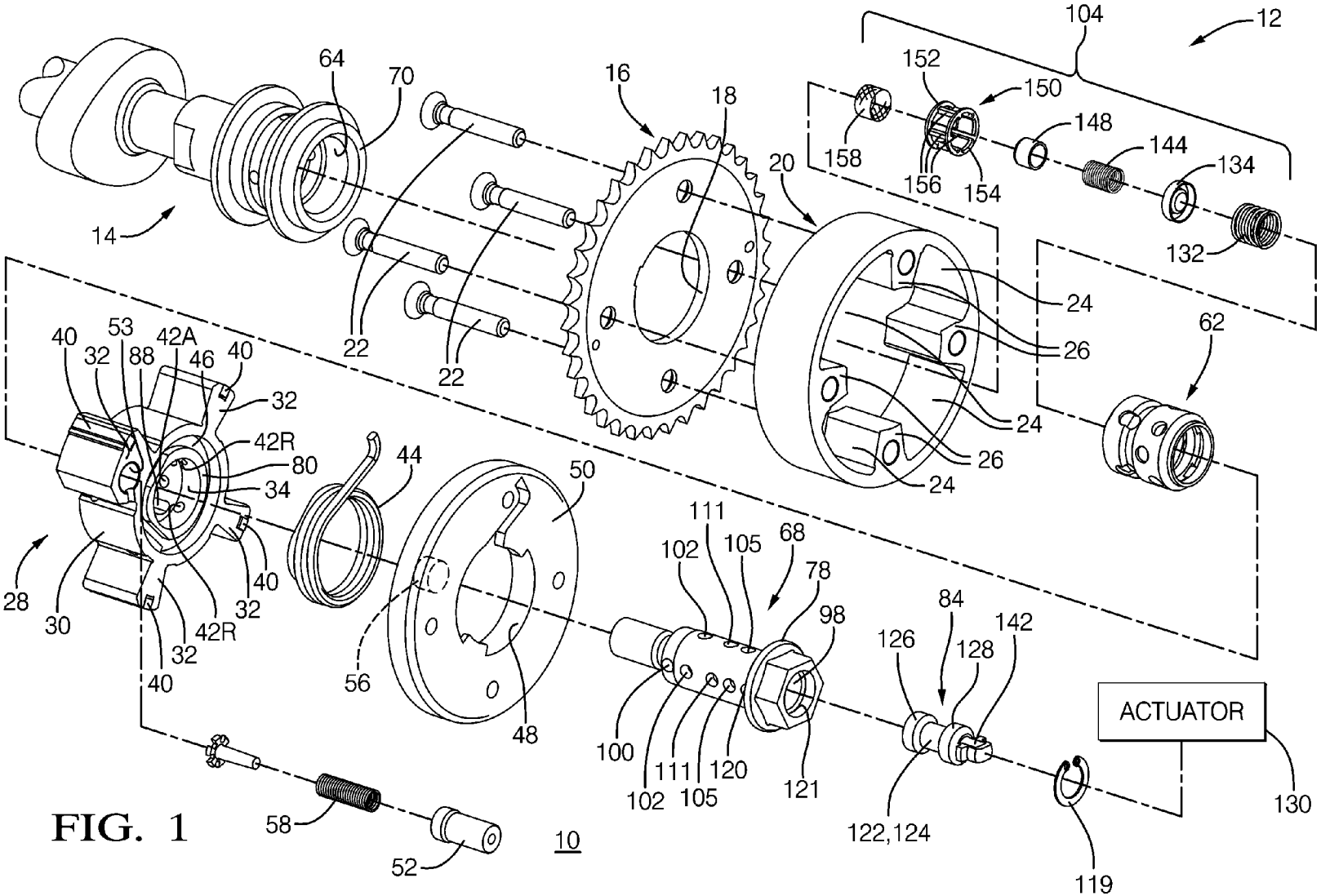
FIG. 1 is an exploded isometric view of a camshaft phaser and a bushing adaptor in accordance with the present invention.
Figure 2A:
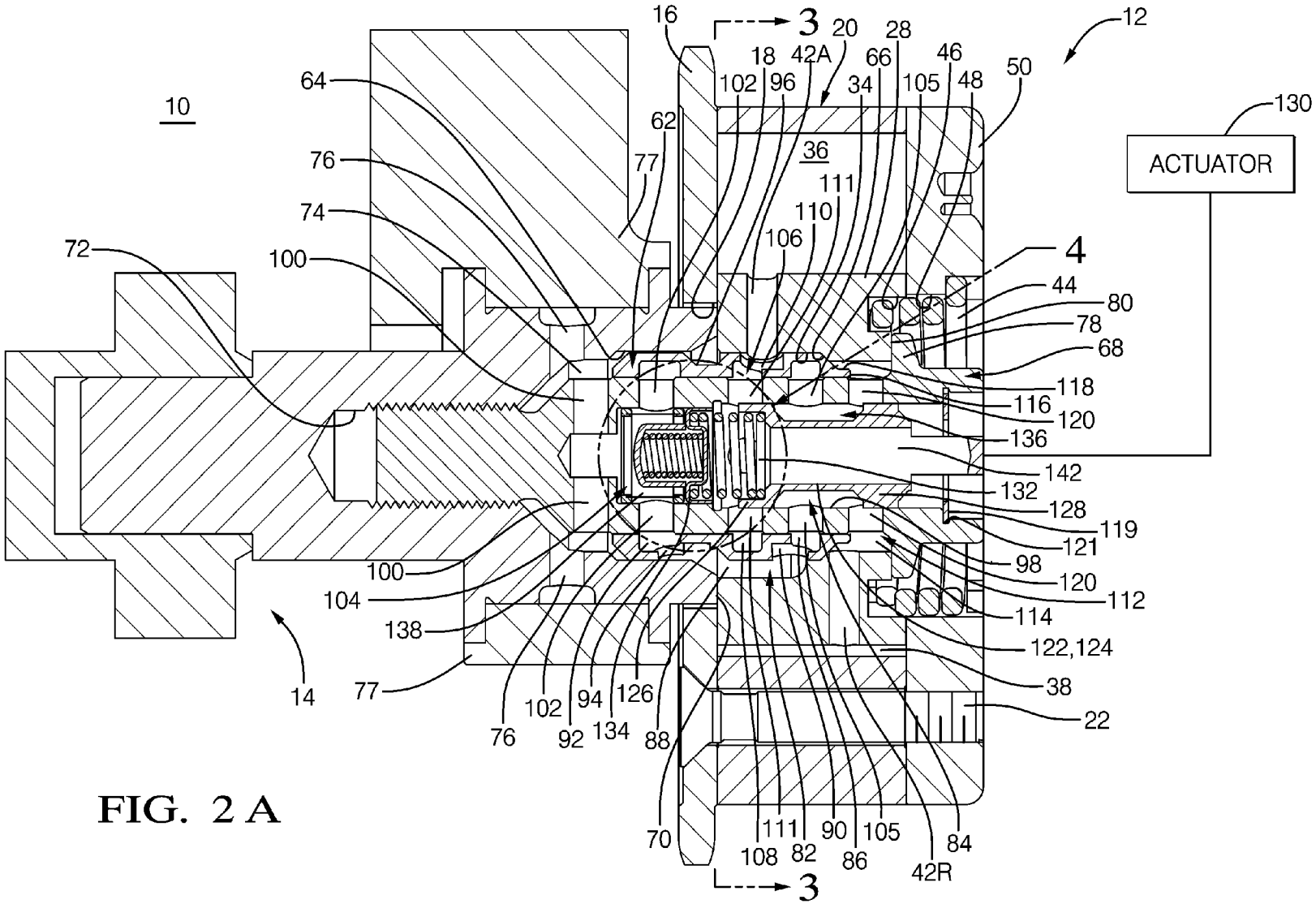
FIG. 2A is an axial cross-section of a camshaft phaser and a bushing adaptor in accordance with the present invention.
Figure 3:
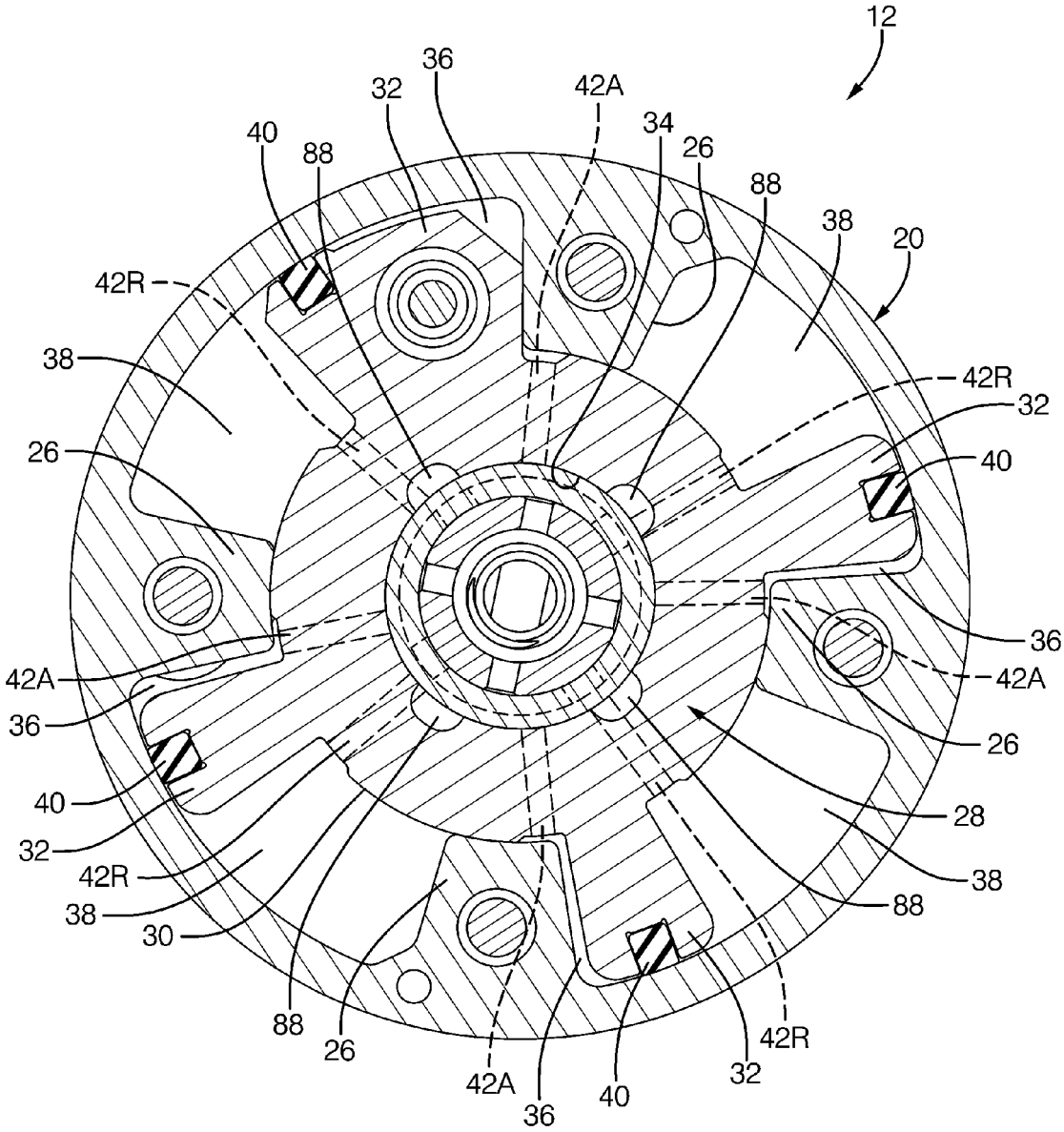
FIG. 3 is a radial cross-section of a camshaft phaser in accordance with the present invention taken in the direction of arrows 3 in FIG. 2A.

In accordance with a preferred embodiment of this invention and referring to FIGS. 1, 2A, and 3, internal combustion engine 10 is shown which includes camshaft phaser 12. Internal combustion engine 10 also includes camshaft 14 which is rotatable based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and exhaust valves can be advanced or retarded in order to achieve desired engine performance.

Camshaft phaser 12 includes sprocket 16 which is driven by a chain or gear (not shown) driven by the crankshaft of internal combustion engine 10. Alternatively, sprocket 16 may be a pulley driven by a belt. Sprocket 16 includes a central bore 18 for receiving camshaft 14 coaxially therethrough which is allowed to rotate relative to sprocket 16. Sprocket 16 is sealingly secured to stator 20 with sprocket bolts 22 in a way that will be described in more detail later.

Stator 20 is generally cylindrical and includes a plurality of radial chambers 24 defined by a plurality of lobes 26 extending radially inward. In the embodiment shown, there are four lobes 26 defining four radial chambers 24, however, it is to be understood that a different number of lobes may be provided to define radial chambers equal in quantity to the number of lobes.

Rotor 28 includes central hub 30 with a plurality of vanes 32 extending radially outward therefrom and central through bore 34 extending axially therethrough. The number of vanes 32 is equal to the number of radial chambers 24 provided in stator 20. Rotor 28 is coaxially disposed within stator 20 such that each vane 32 divides each radial chamber 24 into advance chambers 36 and retard chambers 38. The radial tips of lobes 26 are mateable with central hub 30 in order to separate radial chambers 24 from each other. Preferably, each of the radial tips of vanes 32 includes one of a plurality of wiper seals 40 to substantially seal adjacent advance and retard chambers 36, 38 from each other. Although not shown, each of the radial tips of lobes 26 may include a wiper seal similar in configuration to wiper seal 40.

Central through bore 34 includes a plurality of oil passages 42A, 42R formed radially therethrough (best visible as hidden lines in FIG. 3). Each one of the plurality of oil passages 42A is in fluid communication with one of the advance chambers 36 for supplying oil thereto and therefrom while each one of the plurality of oil passages 42R is in fluid communication with one of the retard chambers 38 for supplying oil thereto and therefrom.

Bias spring 44 is disposed within annular pocket 46 formed in rotor 28 and within central bore 48 of camshaft phaser cover 50. Bias spring 44 is grounded at one end thereof to camshaft phaser cover 50 and is attached at the other end thereof to rotor 28. When internal combustion engine 10 is shut down, bias spring 44 urges rotor 28 to a predetermined angular position within stator 20 in a way that will be described in more detail in the subsequent paragraph.

Lock pin 52 is disposed within lock pin bore 54 formed in one of the plurality of vanes 32 of rotor 28. When internal combustion engine 10 is shut down, bias spring 44 urges rotor 28 into the predetermined position in which lock pin 52 is aligned with receiving hole 56 formed in camshaft phaser cover 50. Receiving hole 56 may include an insert which is made of a material that is more durable than camshaft phaser cover 50. Lock pin spring 58 urges lock pin 52 into receiving hole 56 when lock pin 52 is aligned with receiving hole 56 while internal combustion engine 10 is not running. In this way, rotor 28 is prevented from rotating relative to stator 20 and is therefore held in the predetermined position. When internal combustion engine 10 is running, oil is supplied at a sufficient pressure to act against lock pin 52, thereby compressing lock pin spring 58. In this way, lock pin 52 is retracted from receiving hole 56, thereby allowing rotor 28 to rotate relative to stator 20.

Camshaft phaser cover 50 is sealingly attached to stator 20 by sprocket bolts 22 that extend through sprocket 16 and stator 20 and threadably engage camshaft phaser cover 50. In this way, stator 20 is securely clamped between sprocket 16 and camshaft phaser cover 50 in order to axially and radially secure sprocket 16, stator 20, and camshaft cover 50 to each other.

Now referring to FIGS. 1, 2A, 3, 5, and 6, bushing adaptor 62 is coaxially disposed within pocket 64 of camshaft 14 in a close fitting relationship. Bushing adaptor 62 is also coaxially disposed within central through bore 34 of rotor 28 in a press fit relationship to prevent relative rotation therebetween and may be press fit within central through bore 34 until bushing adaptor 62 abuts stop surface 66 of central through bore 34. When camshaft phaser 12 is attached to camshaft 14, bushing adaptor 62 coaxially aligns camshaft phaser 12 with camshaft 14. This allows the rotor 28 to be made more axially compact because axial space is not needed within rotor 28 for receiving camshaft 14 therewithin in order to coaxially align camshaft phaser 12 with camshaft 14. A network of oil passages is defined in part by bushing adaptor 62 in a way that will be described in detail later.

Camshaft phaser 12 is attached to camshaft 14 with camshaft phaser attachment bolt 68 which extends axially through bushing adaptor 62 in a close fitting relationship. Rotor 28 is positioned against axial face 70 of camshaft 14 which is provided with threaded hole 72 extending axially into camshaft 14 from pocket 64.

Annular oil chamber 74 is formed radially between camshaft phaser attachment bolt 68 and pocket 64 for receiving oil from camshaft oil passages 76 formed radially through camshaft 14. Oil is supplied to camshaft oil passages 76 from internal combustion engine 10 through an oil gallery (not shown) in a camshaft bearing 77. When camshaft phaser attachment bolt 68 is tightened to a predetermined torque, head 78 of camshaft phaser attachment bolt 68 acts axially on bolt surface 80 of rotor 28. In this way, camshaft phaser 12 is axially secured to camshaft 14 and relative rotation between rotor 28 and camshaft 14 is thereby prevented.

Bushing adaptor 62 defines at least in part supply passage 82 for communicating pressurized oil from internal combustion engine 10 to control valve 84. Supply passage 82 may be defined in part by first annular groove 86 formed on the inside diameter of bushing adaptor 62. Annular groove 86 may be positioned axially within rotor 28.

Supply passage 82 may be further defined by axial grooves 88 which extend axially part way into central through bore 34 of rotor 28. Axial grooves 88 may be in fluid communication with first annular groove 86 through first connecting passages 90 which extend radially through bushing adaptor 62.

Supply passage 82 may be further defined by second annular groove 92 formed on the inside diameter of bushing adaptor 62 and which may be positioned axially within pocket 64 of camshaft 14. Second annular groove 92 may be in fluid communication with axial grooves 88 through second connecting passages 94 which extend radially through bushing adaptor 62.

Supply passage 82 may be further defined by third annular groove 96 formed on the outside diameter of bushing adaptor 62 and axially between first annular groove 86 and second annular groove 92. Third annular groove 96 may be in fluid communication with second annular groove 92 through second connecting passages 94 and may also be in fluid communication with axial grooves 88 by axially positioning third annular groove 96 on the outside diameter of bushing adaptor 62 such that axial grooves 88 at least partly overlap axially with third annular groove 96.

Supply passage 82 may be further defined by blind bore 98 formed axially within camshaft phaser attachment bolt 68. Blind bore 98 begins at the end of camshaft phaser attachment bolt 68 defined by head 78 and may extend to a point within camshaft phaser attachment bolt 68 that is axially aligned with annular oil chamber 74. First radial drillings 100 extend radially through camshaft phaser attachment bolt 68 and provide fluid communication from annular oil chamber 74 to blind bore 98 while second radial drillings 102 are spaced axially apart from first radial drillings 100 and extend radially through camshaft phaser attachment bolt 68 to provide fluid communication from blind bore 98 to second annular groove 92.

Check valve assembly 104 may be disposed axially between first radial drillings 100 and second radial drillings 102 in order to allow pressurized oil to be supplied from internal combustion engine 10 to control valve 84 while preventing oil from back-flowing from control valve 84 to internal combustion engine 10. Check valve assembly 104 will be described in more detail later.

Camshaft phaser attachment bolt 68 includes supply drillings 105 extending radially therethrough for providing fluid communication between first annular groove 86 and blind bore 98. Supply drillings 105 allow pressurized oil to be supplied to control valve 84.

In addition to defining at least in part supply passage 82, bushing adaptor 62, also defines at least in part advance passage 106 for selectively communicating pressurized oil from control valve 84 to advance chambers 36 and for venting oil therefrom. Advance passage 106 may be defined at least in part by fourth annular groove 108 formed on the inside diameter of bushing adaptor 62 and axially between first annular groove 86 and second annular groove 92. Through advance oil connecting passages 110, fourth annular groove 108 is in fluid communication with oil passages 42A that are in fluid communication advance chambers 36. Advance oil connecting passages 110 extend axially from fourth annular groove 108 through bushing adaptor 62.

Camshaft phaser attachment bolt 68 includes advance drillings 111 extending radially therethrough for providing fluid communication between fourth annular groove 108 and blind bore 98. Advance drillings 111 allow pressurized oil to be selectively supplied from control valve 84 to advance chambers 36.

In addition to defining at least in part supply passage 82 and advance passage 106, bushing adaptor 62 also defines at least in part retard passage 112 for selectively communicating pressurized oil from control valve 84 to retard chambers 38. Retard passage 112 may be defined by axial space 114 formed axially between axial end 116 and head 78. Axial end 116 may be defined by reduced diameter section 118 which provides radial clearance between central through bore 34 of rotor 28 and reduced diameter section 118. Axial space 114 is further defined radially between rotor 28 and camshaft phaser attachment bolt 68. Axial space 114 is in fluid communication with oil passages 42R that are in fluid communication with retard chambers 38.

Camshaft phaser attachment bolt 68 includes retard drillings 120 extending radially through camshaft phaser attachment bolt 68 for providing fluid communication between axial space 114 and blind bore 98. Retard drillings 120 allow pressurized oil to be selectively supplied from control valve 84 to retard chambers 38.

Control valve 84 is disposed within camshaft phaser attachment bolt 68 and retained therein by retaining ring 119 which fits within groove 121 of camshaft phaser attachment bolt 68. Control valve 84 includes valve spool 122 with body 124 that is generally cylindrical, hollow and dimensioned to provide annular clearance between body 124 and blind bore 98 of camshaft attachment bolt 68.

Valve spool 122 also includes advance land 126 extending radially outward from body 124 for selectively blocking fluid communication between supply drillings 105 and advance drillings 111. Advance land 126 fits within blind bore 98 of camshaft phaser attachment bolt 68 in a close fitting relationship to substantially prevent oil from passing between advance land 126 and blind bore 98.

Valve spool 122 also includes retard land 128 extending radially outward from body 124 for selectively blocking fluid communication between supply drillings 105 and retard drillings 120. Retard land 128 is positioned axially away from advance land 126 and fits within blind bore 98 of camshaft phaser attachment bolt 68 in a close fitting relationship to substantially prevent oil from passing between retard land 128 and blind bore 98.

Figure 4A:
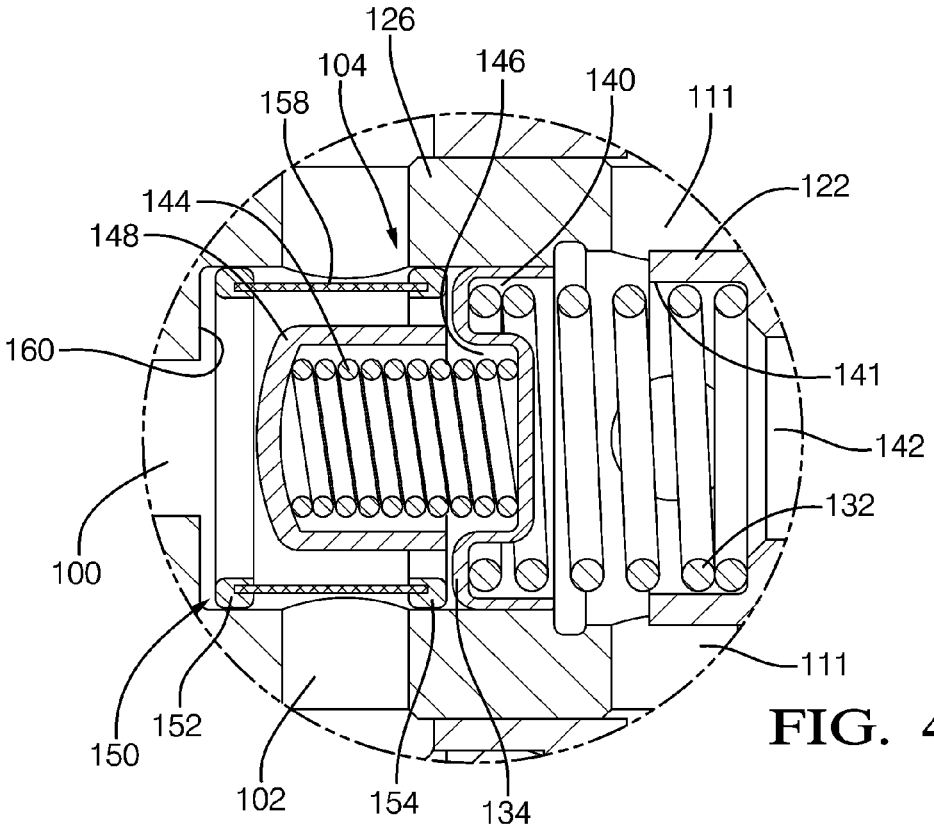
FIG. 4A is an enlarged view of a check valve from FIG. 2A shown in an open position.
Figure 4B:
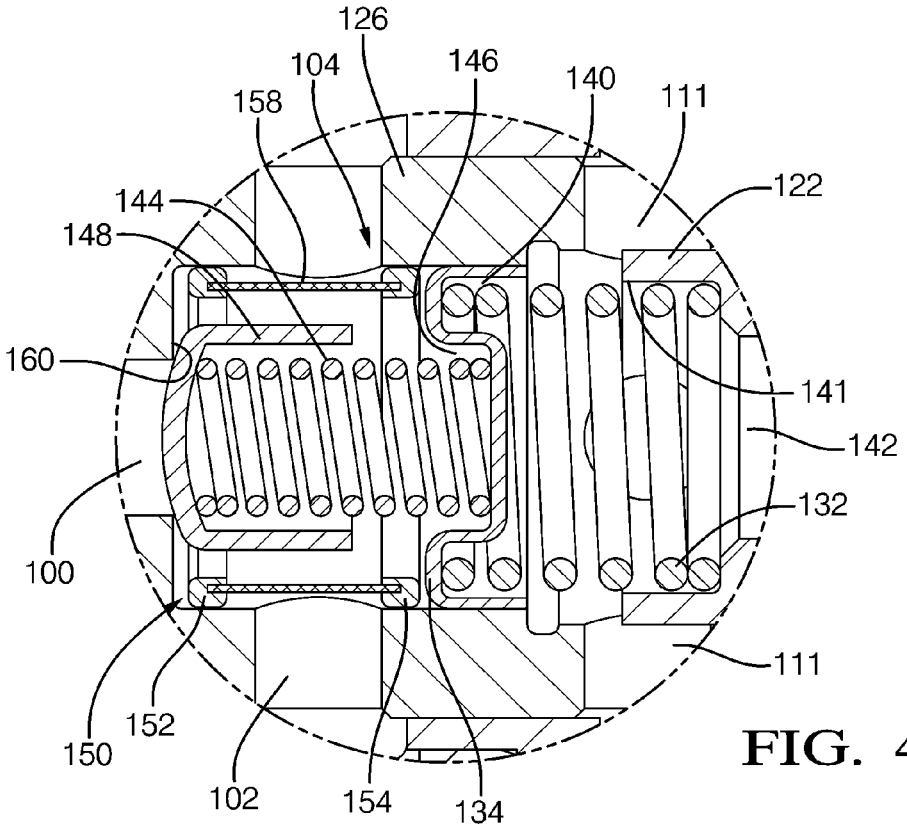
FIG. 4B is the check valve of FIG. 4A shown in a closed position.
Figure 5:
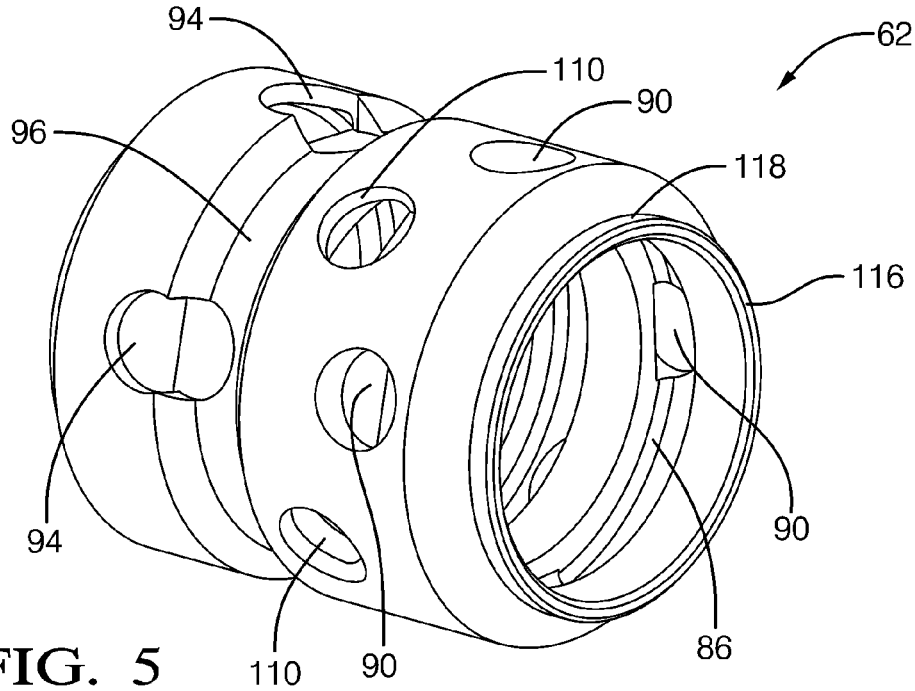
FIG. 5 is an enlarged isometric view of the bushing adaptor of FIG. 1.
Figure 6:
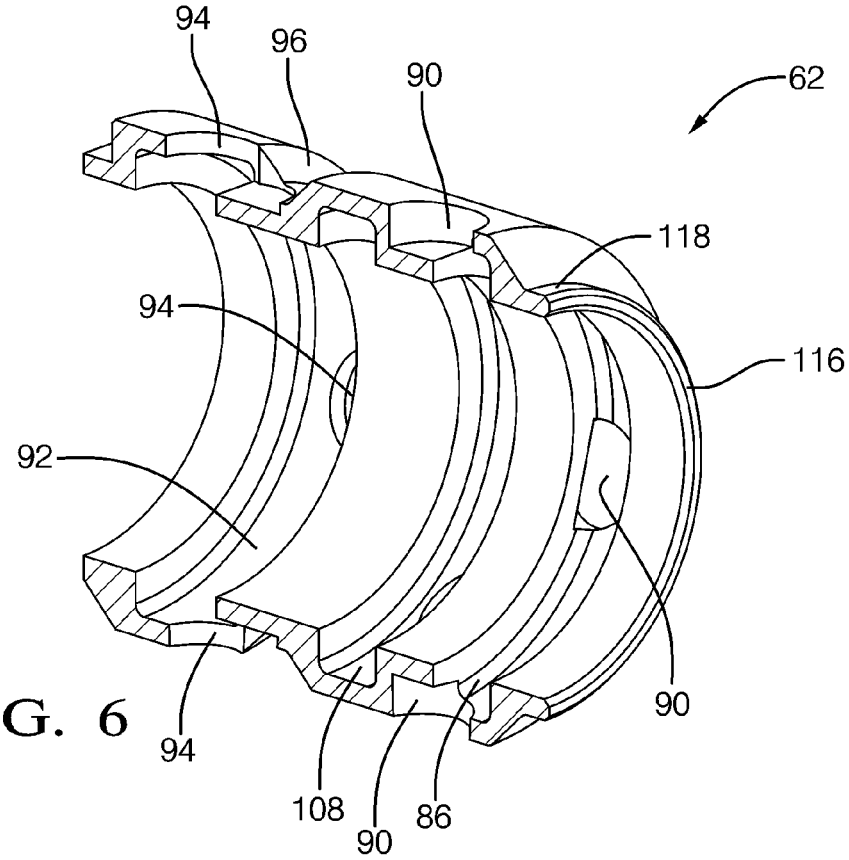
FIG. 6 is an isometric cross-section of the bushing adaptor of FIG. 5.

Now referring to FIGS. 1, 2A, and 4A, valve spool 122 is axially moveable within blind bore 98 with input from actuator 130 and spool spring 132. Spool spring 132 is grounded to camshaft phaser attachment bolt 68 by seat 134 which is sealingly fixed within blind bore 98 between second radial drillings 102 and advance drillings 111. Seat 134 sealingly separates blind bore 98 into spool section 136 and check valve section 138. A first end of spool spring 132 is seated within annular recess 140 of seat 134 while a second end of spool spring 132 is seated within spring pocket 141 formed in an end of valve spool 122. In this way, spool spring 132 biases valve spool 122 away from seat 134 when actuator 130 is not energized, thereby positioning valve spool 122 within spool section 136 such that pressurized oil is supplied to retard drillings 120 from supply drillings 105 while oil is vented from advance drillings 111 through central passage 142 of valve spool 122 and through the end of blind bore 98 that is adjacent to head 78. In contrast, when actuator 130 is energized, the biasing force of spool spring 132 is overcome to position valve spool 122 within spool section 136 such that pressurized oil is supplied to advance drillings 111 while oil is vented from retard drillings 120 to the end of blind bore 98 that is adjacent to head 78.

Now referring to FIGS. 1, 2A, 4A, and 4B, check valve assembly 104 includes check valve spring 144 which is grounded to seat 134. A first end of check valve spring 144 is seated within check valve spring recess 146 of seat 134 while a second end of check valve spring 144 is seated within the open end of cup-shaped valve member 148.

Check valve spring 144 and valve member 148 are disposed radially within framework 150. Framework 150 includes first and second annular rings 152, 154 which are spaced axially apart from each other and which are joined together by ribs 156 extending from first annular ring 152 to second annular ring 154. Ribs 156 extend radially inward slightly from first and second annular rings 152, 154 in order to guide and center valve member 148 within framework 150. Filter 158 is disposed between first and second annular rings 152, 154 and circumferentially around the entirety of ribs 156 in order to prevent any foreign matter that may present in the pressurized oil from reaching control valve 84.

In operation, pressurized oil supplied from internal combustion engine 10 urges valve member 148 away from shoulder 160 formed in blind bore 98 between first radial drillings 100 and second radial drillings 102. In this way, oil is communicated from first radial drillings 100 to the interior of framework 150 before being filtered by filter 158 and communicated through second radial drillings 102 to control valve 84. Check valve assembly 104 is shown in this operating condition in FIG. 4A. If, however, oil pressure within camshaft phaser 12 is greater than the oil pressure being supplied by internal combustion engine 10, check valve spring 144 together with oil pressure from camshaft phaser 12 will urge valve member 148 to seat against shoulder 160. The closed end of valve member 148 may be domed or spherical in order to facilitate positive sealing against shoulder 160. In this way oil is prevented from back-flowing from control valve 84 to internal combustion engine 10. Check valve assembly 104 is shown in this operating condition in FIG. 4B.

Figure 2B:
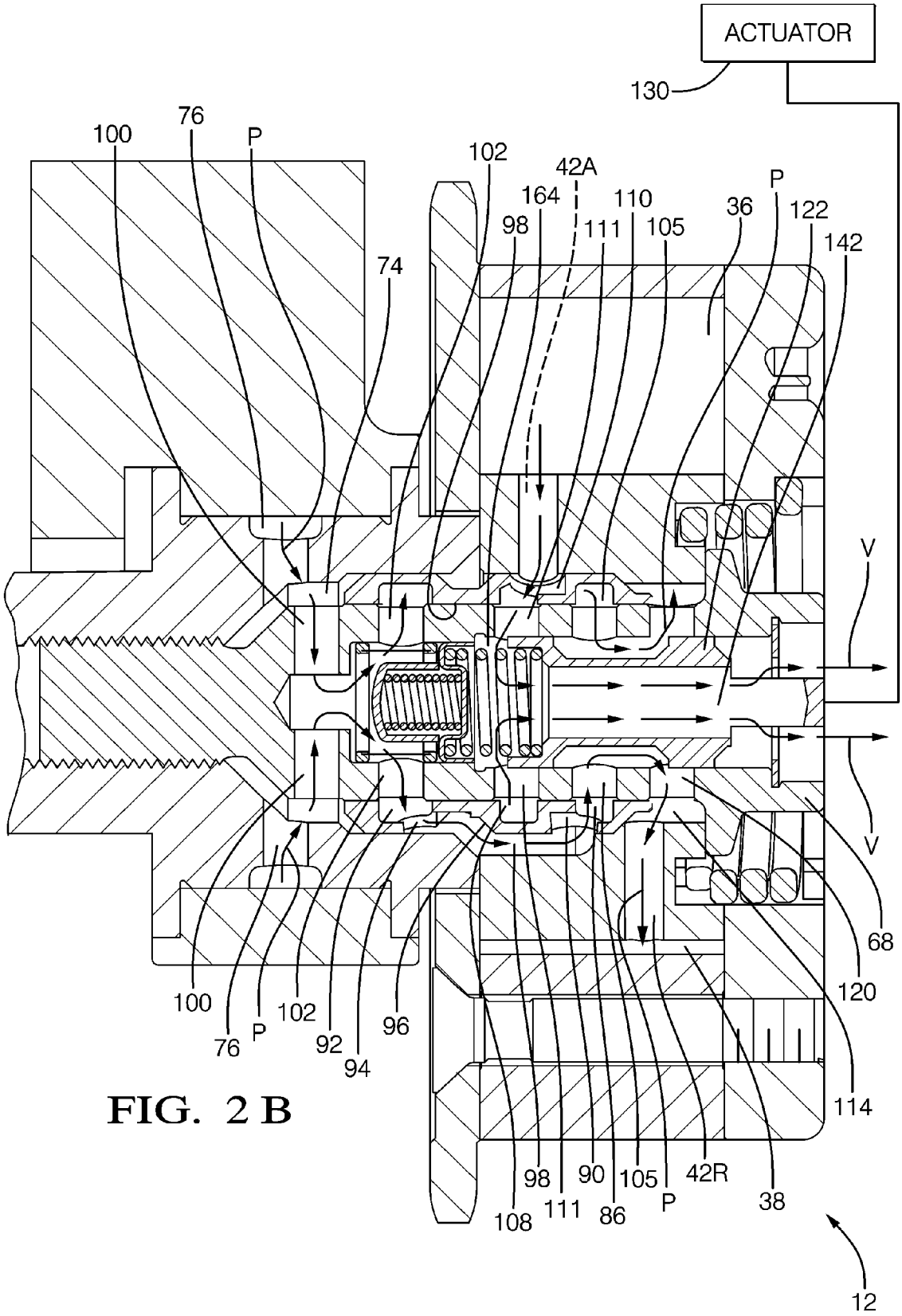
FIG. 2B is the axial cross-section of FIG. 2A showing the check valve open and the control valve in a first position for supplying pressurized oil to the retard chambers and for venting oil from the advance chambers.
Figure 2:
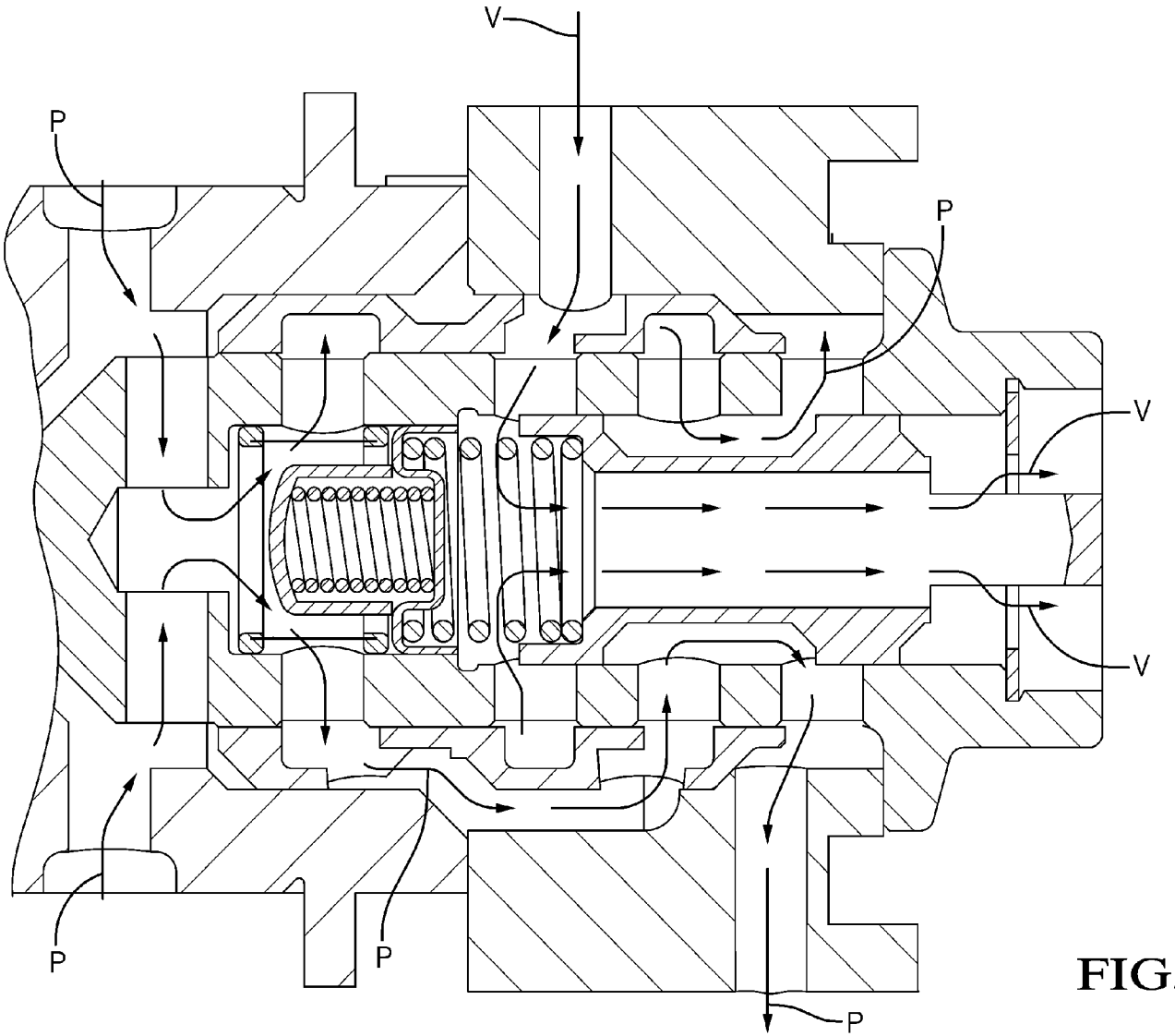
FIG. 2C is the axial cross section of FIG. 2A showing the check valve open and the control valve in a second position for supplying pressurized oil to the advance chambers and for venting oil from the retard chambers.

Now referring to FIG. 2B, camshaft phaser 12 is shown with actuator 130 in an unenergized state of operation. In this state of operation, valve spool 122 is positioned to allow pressurized oil to be supplied to retard chambers 38 where the path taken by the pressurized oil is represented by arrows P. Oil from camshaft oil passages 76 is communicated therefrom to annular oil chamber 74 where it is then supplied to blind bore 98 through first radial drillings 100. From blind bore 98, oil is communicated to second annular groove 92 through second radial drillings 102 and then to third annular groove 96 through second connecting passages 94. From third annular groove 96, oil is communicated to axial grooves 88 and then to first annular groove 86 through first connecting passages 90. The oil is then communicated from first annular groove 86 through supply drillings 105 where valve spool 122 allows oil to be communicated to retard drillings 120 while substantially preventing oil from being communicated to advance drillings 111. From retard drillings 120, the oil is supplied to axial space 114 where the oil is communicated to retard chambers 38 through oil passages 42R.

At the same time, i.e. when actuator 30 is unenergized, oil within advance chambers 36 is allowed to be vented through central passage 142 where the path taken by the vented oil is represented by arrows V. The oil is communicated from advance chambers 36 to fourth annular groove 108 through oil passages 42A and advance oil connecting passages 110. The oil is then communicated to central passage 142 through advance drillings 111 where the oil is then vented through the end of camshaft phaser attachment bolt 68. For clarity, FIG. 2B' is provided without reference numbers and without elements that do not define the oil passages to clearly show the path taken by the pressurized oil represented by arrows P and the path taken by the vented oil represented by arrows V.

Figure 2C:
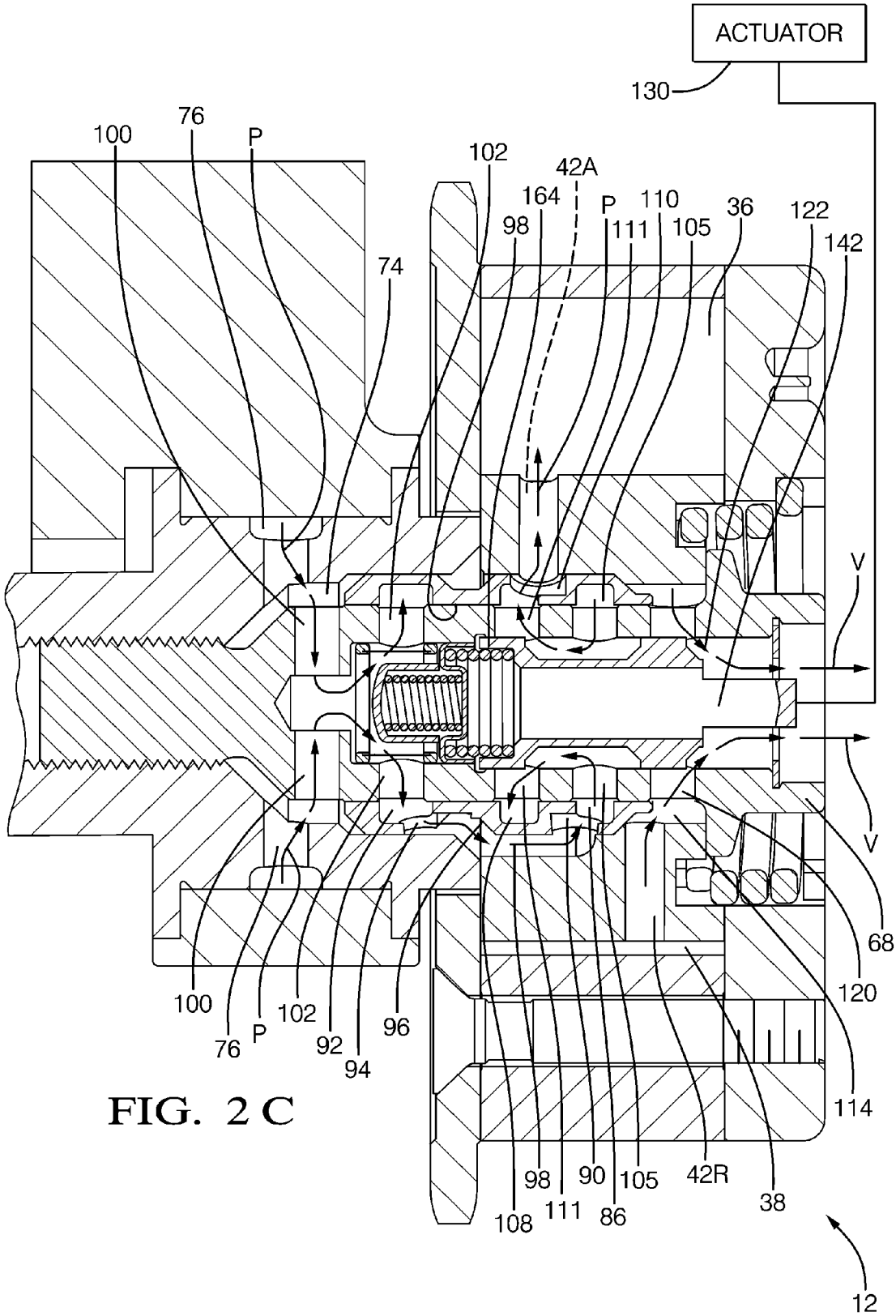
Figure 2C:
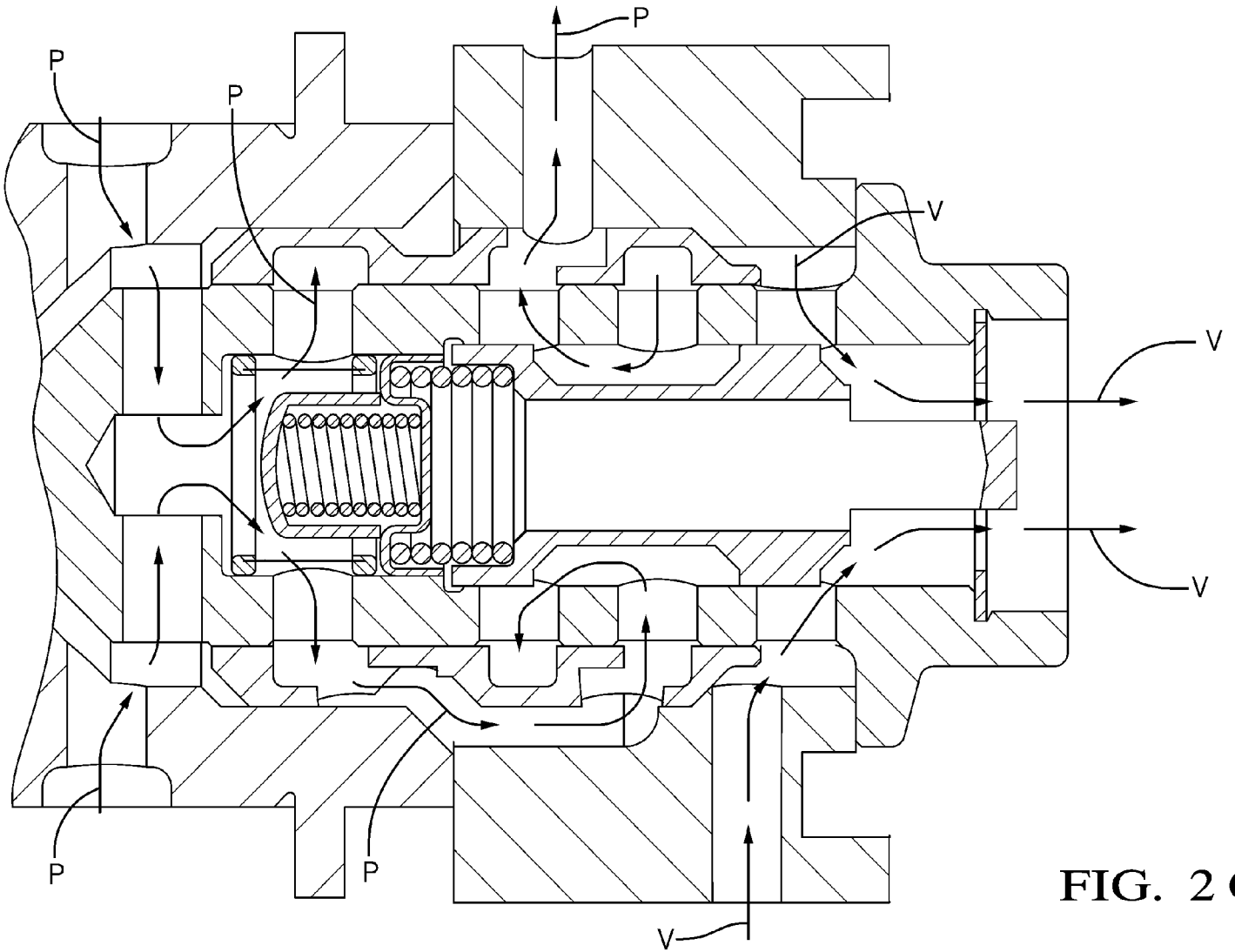

Now referring to FIG. 2C, camshaft phaser 12 is shown with actuator 130 in an energized state of operation. In this state of operation, valve spool 122 is positioned to allow pressurized oil to be supplied to advance chambers 36 where the path taken by the pressurized oil is represented by arrows P. Oil from camshaft oil passages 76 is communicated therefrom to annular oil chamber 74 where it is then supplied to blind bore 98 through first radial drillings 100. From blind bore 98, oil is communicated to second annular groove 92 through second radial drillings 102 and then to third annular groove 96 through second connecting passages 94. From third annular groove 96, oil is communicated to axial grooves 88 and then to first annular groove 86 through first connecting passages 90. The oil is then communicated from first annular groove 86 through supply drillings 105 where valve spool 122 allows oil to be communicated to advance drillings 111 while substantially preventing oil from being communicated to retard drillings 120. From advance drillings 111, the oil is supplied to fourth annular groove 108 through advance oil connecting passages 110. From fourth annular groove 108, the oil is supplied to advance chambers 36 through oil passages 42A.

At the same time, i.e. when actuator 30 is energized, oil within retard chambers 38 is allowed to be vented where the path taken by the vented oil is represented by arrows V. The oil is communicated from retard chambers 38 to axial space 114 through oil passages 42R. From axial space 114, the oil is vented through the end of camshaft phaser attachment bolt 68 through retard drillings 120. For clarity, FIG. 2C' is provided without reference numbers and without elements that do not define the oil passages to clearly show the path taken by the pressurized oil represented by arrows P and the path taken by the vented oil represented by arrows V.

Figure 7A:
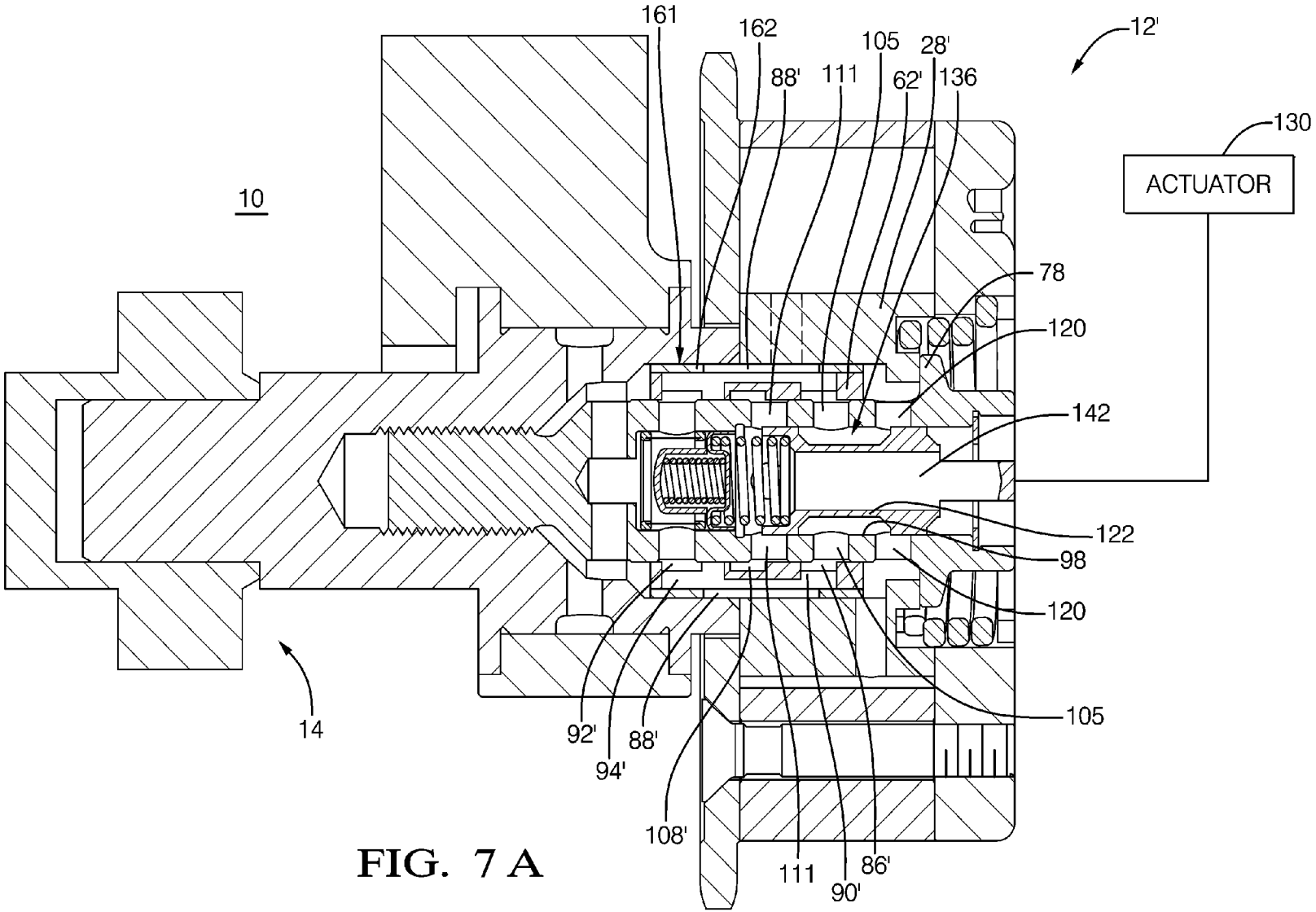
FIG. 7A is an axial cross-section of a camshaft phaser and a bushing adaptor assembly in accordance with a second embodiment of the present invention.
Figure 8:
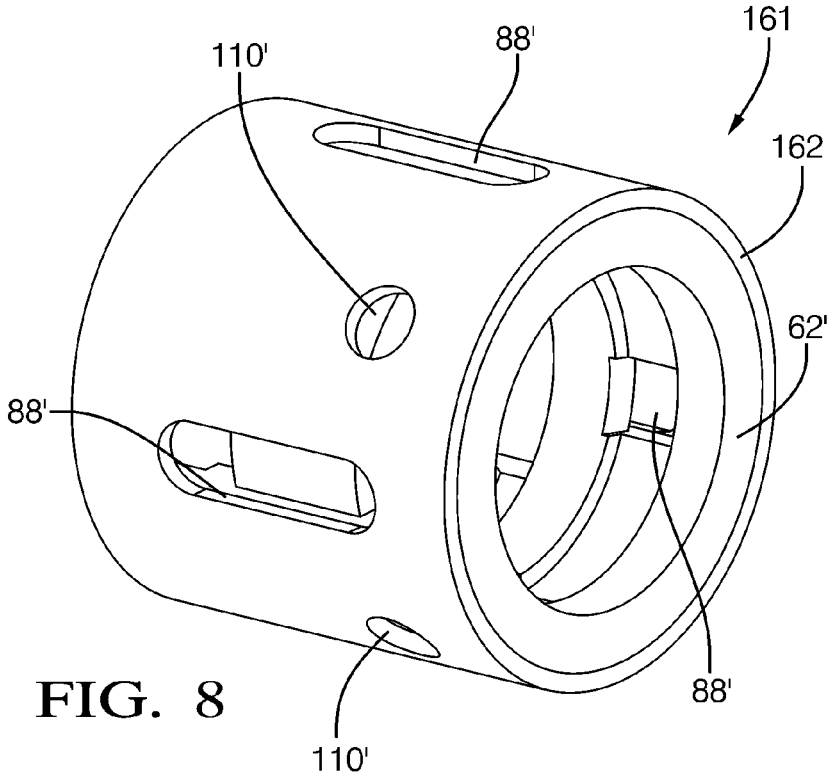
FIG. 8 is an is an enlarged isometric view of the bushing adaptor assembly of FIG. 7A.
Figure 9:
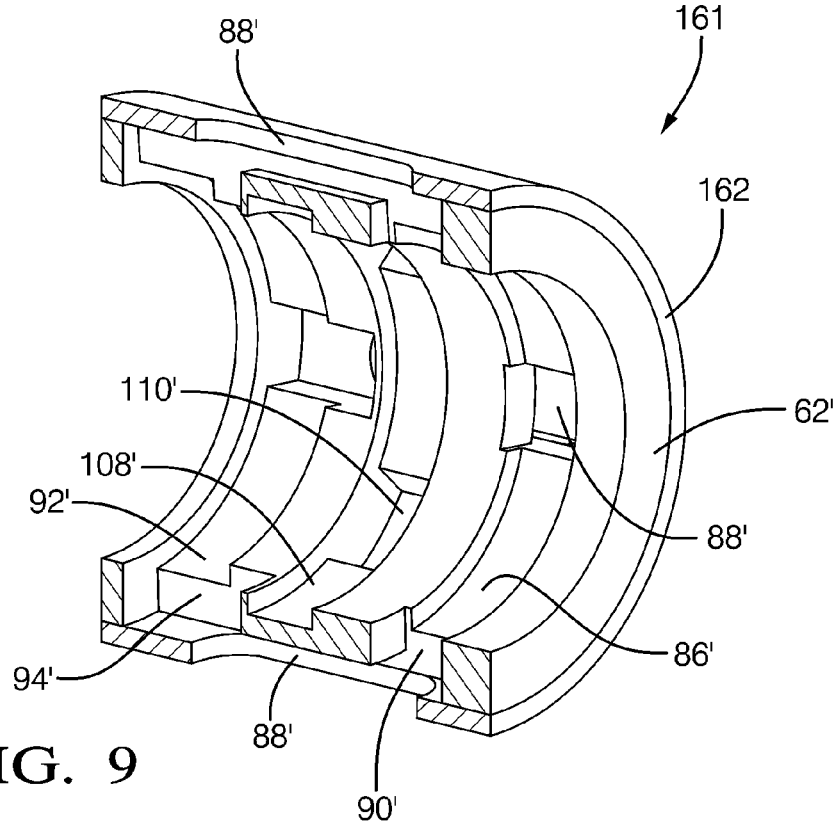
FIG. 9 is an isometric cross-section of the bushing adaptor assembly of FIG. 8.

Now referring to FIGS. 7A, 8, and 9, a second embodiment camshaft phaser 12' in accordance with the present invention is shown. Reference numbers of elements used in the description of camshaft phaser 12 will also be used in the description of elements of camshaft phaser 12' that are identical to the elements of camshaft phaser 12. The differences of camshaft phaser 12' relative to camshaft phaser 12 will now be described. Camshaft phaser 12' includes rotor 28' and bushing adaptor assembly 161 which includes bushing adaptor 62' and bushing adaptor sleeve 162. Rotor 28' is the same as rotor 28 from the first embodiment except that rotor 28' does not include axial grooves 88. In this embodiment, the function of axial grooves 88 is fulfilled by bushing adaptor sleeve 162 which is press fit into rotor 28' and which radially surrounds bushing adaptor 62' in a close fitting relationship to substantially prevent oil from passing between the interface of bushing adaptor sleeve 162 and bushing adaptor 62'. Bushing adaptor sleeve 162 includes axial grooves 88' formed radially therethrough that are in fluid communication with first annular groove 86' through first connecting passages 90'. Axial grooves 88' are also in fluid communication with second annular groove 92' through second connecting passages 94'. In this way, pressurized oil is communicated from internal combustion engine 10 to control valve 84 through supply drillings 105. When control valve 84 is not energized, valve spool 122 is positioned within spool section 136 such that pressurized oil is supplied to retard drillings 120 from supply drillings 105 while oil is vented from advance drillings 111 through central passage 142 of valve spool 122 and through the end of blind bore 98 that is adjacent to head 78. In contrast, when actuator 130 is energized, valve spool 122 is positioned within spool section 136 such that pressurized oil is supplied to advance drillings 111 while oil is vented from retard drillings 120 to the end of blind bore 98 that is adjacent to head 78.

Figure 7B:
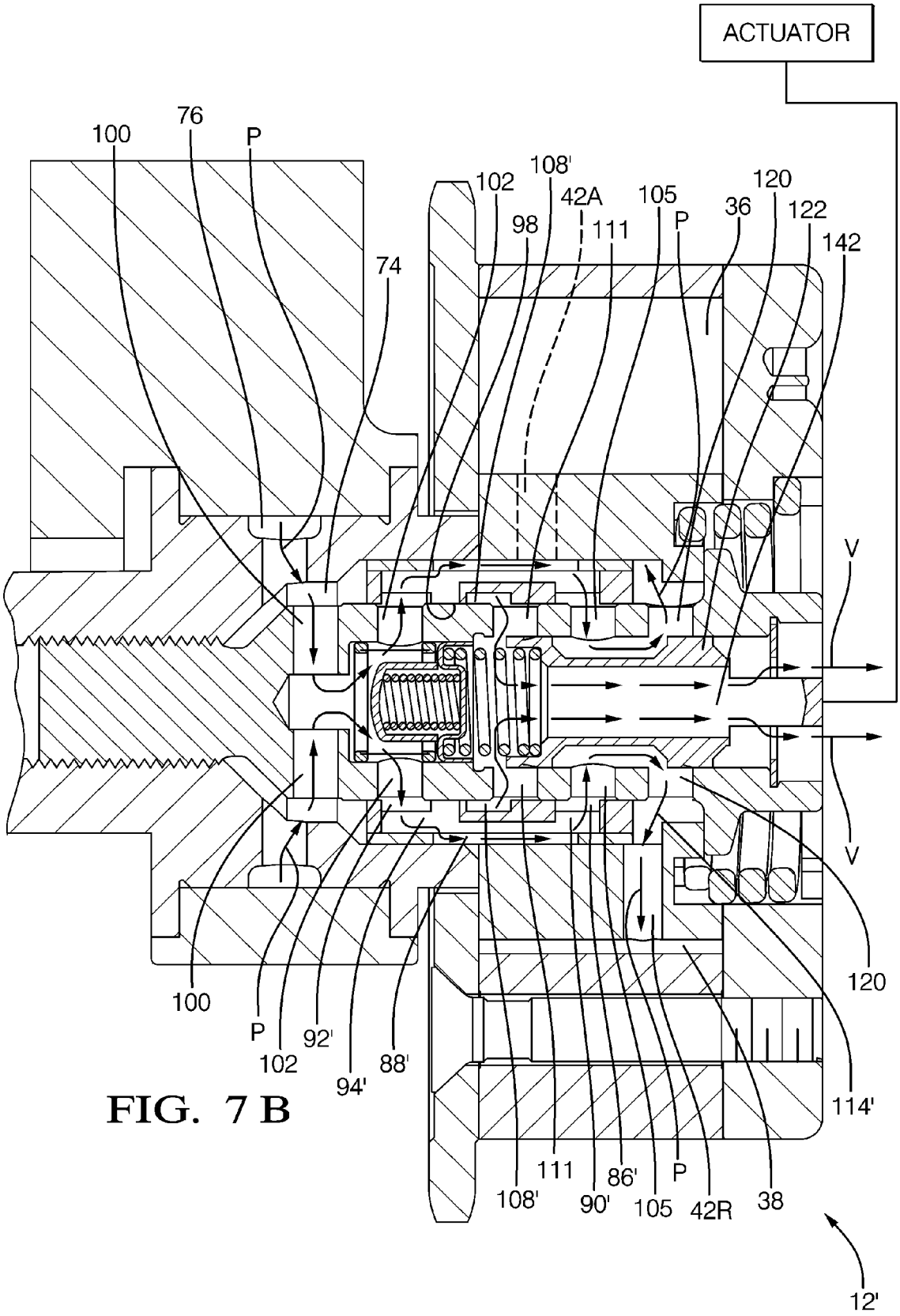
FIG. 7B is the axial cross-section of FIG. 7A showing the check valve open and the control valve in a first position for supplying pressurized oil to the retard chambers and for venting oil from the advance chambers.
Figure 7:
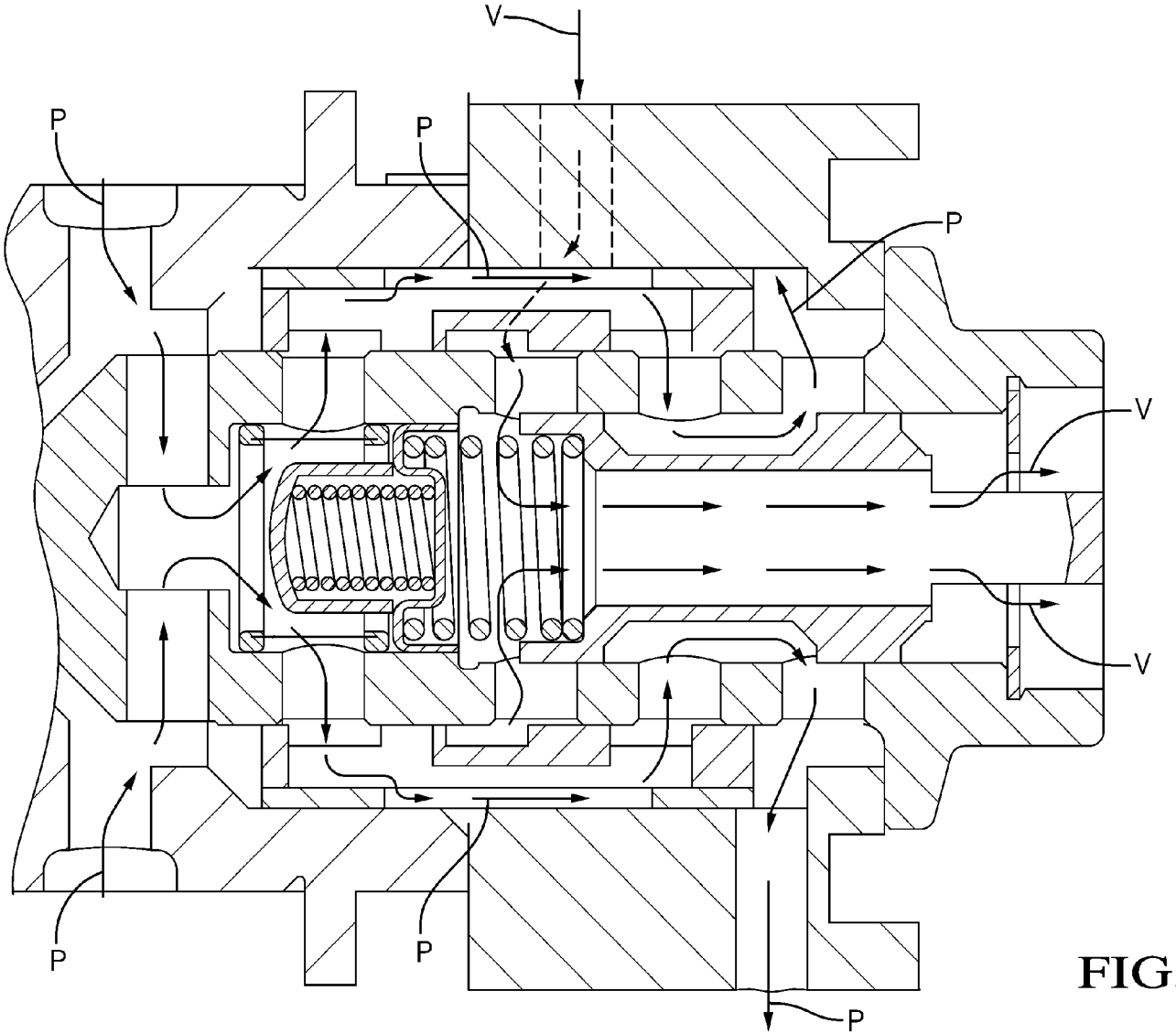
FIG. 7C is the axial cross section of FIG. 7A showing the check valve open and the control valve in a second position for supplying pressurized oil to the advance chambers and for venting oil from the retard chambers.

Now referring to FIG. 7B, camshaft phaser 12' is shown with actuator 130 in an unenergized state of operation where the path taken by the pressurized oil is represented by arrows P. In this state of operation, valve spool 122 is positioned to allow pressurized oil to be supplied to retard chambers 38. Oil from camshaft oil passages 76 is communicated therefrom to annular oil chamber 74 where it is then supplied to blind bore 98 through first radial drillings 100. From blind bore 98, oil is communicated to second annular groove 92' through second radial drillings 102 and then to axial grooves 88' through second connecting passages 94'. From axial grooves 88', the oil is communicated to first annular groove 86' through first connecting passages 90'. The oil is then communicated from first annular groove 86' through supply drillings 105 where valve spool 122 allows oil to be communicated to retard drillings 120 while substantially preventing oil from being communicated to advance drillings 111. From retard drillings 120, the oil is supplied to axial space 114' where the oil is communicated to retard chambers 38 through oil passages 42R.

At the same time, i.e. when actuator 30 is unenergized, oil within advance chambers 36 is allowed to be vented through central passage 142 where the path taken by the vented oil is represented by arrows V. The oil is communicated from advance chambers 36 to fourth annular groove 108' through advance oil connecting passages 110 (not visible in FIG. 7B). From fourth annular groove 108', the oil is communicated to central passage 142 through advance drillings 111. For clarity, FIG. 7B' is provided without reference numbers and without elements that do not define the oil passages to clearly show the path taken by the pressurized oil represented by arrows P and the path taken by the vented oil represented by arrows V.

Figure 7C:
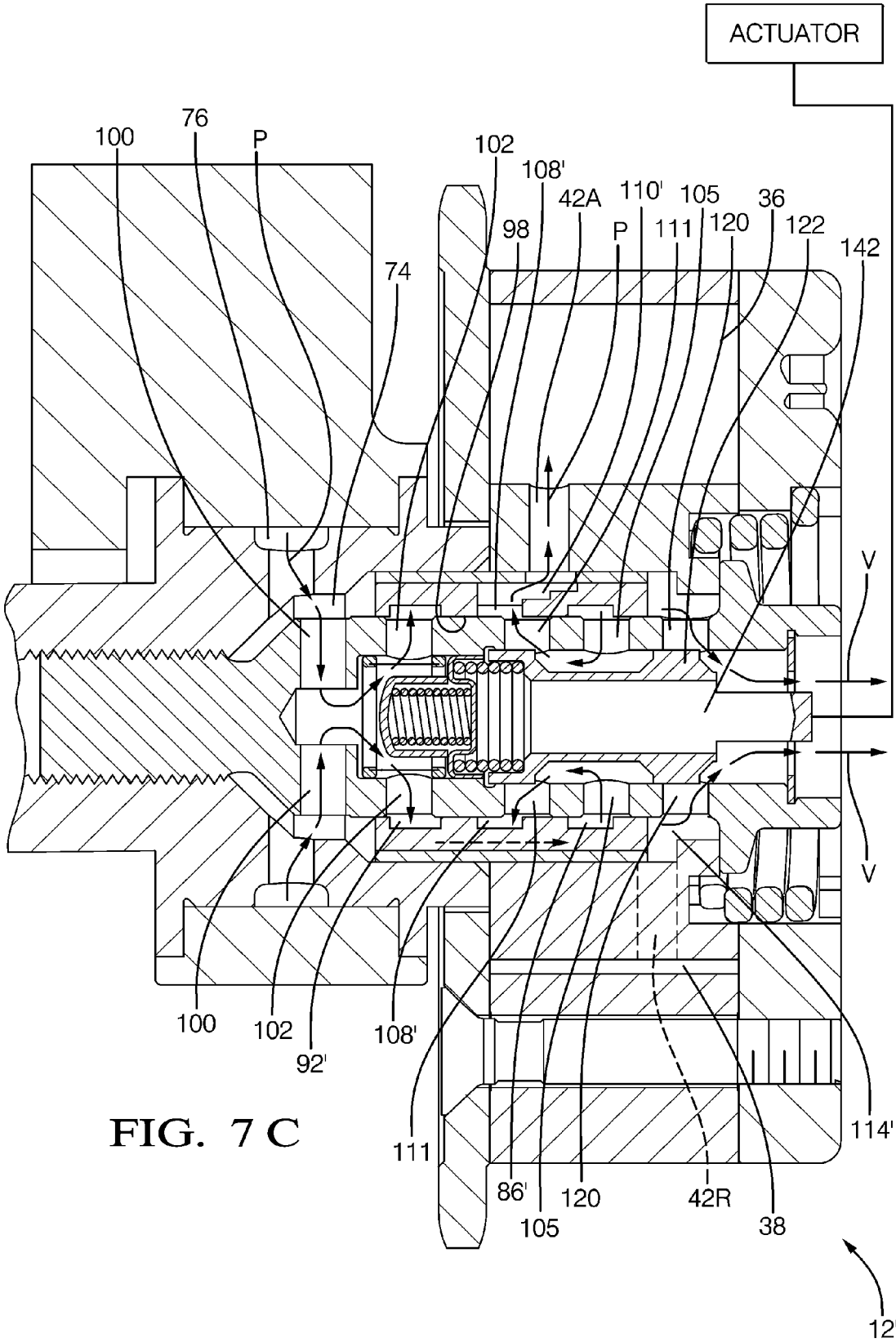
Figure 7:
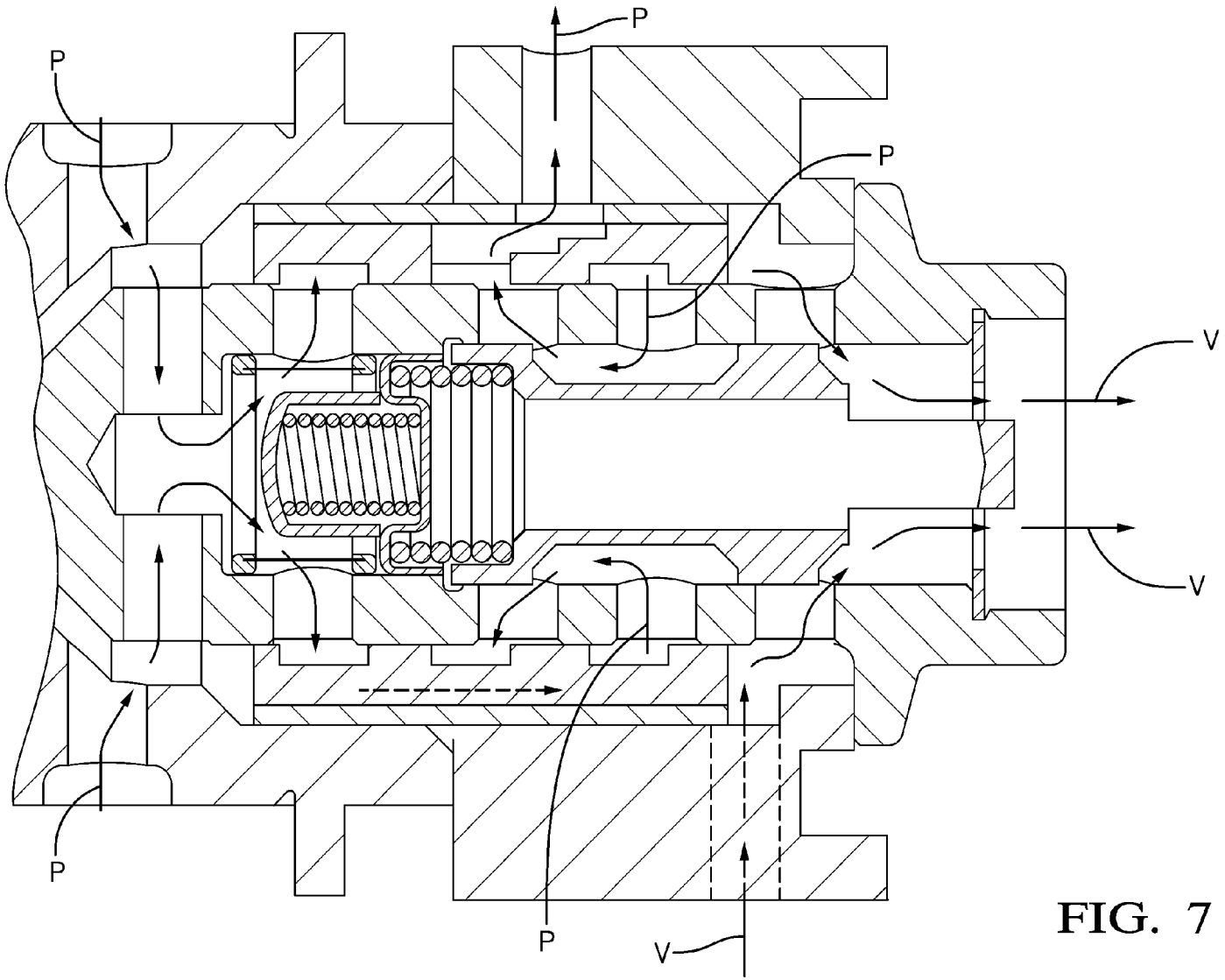

Now referring to FIG. 7C, camshaft phaser 12 is shown with actuator 130 in an energized state of operation. The section of FIG. 7C is taken in an alternate location from FIG. 7B in order to more clearly show the path of pressurized oil to advance chambers 36. In this state of operation, valve spool 122 is positioned to allow pressurized oil to be supplied to advance chambers 36 where the path taken by the pressurized oil is represented by arrows P. Oil from camshaft oil passages 76 is communicated therefrom to annular oil chamber 74 where it is then supplied to blind bore 98 through first radial drillings 100. From blind bore 98, oil is communicated to second annular groove 92' through second radial drillings 102 and then to axial grooves 88' (not visible in FIG. 7C) through second connecting passages 94' (not visible in FIG. 7C). From axial grooves 88', the oil is communicated to first annular groove 86' through first connecting passages 90' (not visible in FIG. 7C). The oil is then communicated from first annular groove 86' through supply drillings 105 where valve spool 122 allows oil to be communicated to advance drillings 111 while substantially preventing oil from being communicated to retard drillings 120. From advance drillings 111, the oil is supplied to fourth annular groove 108' and then through advance oil connecting passages 110' to advance chambers 36 through oil passages 42A.

At the same time, i.e. when actuator 30 is energized, oil within retard chambers 38 is allowed to be vented where the path taken by the vented oil is represented by arrows V. The oil is communicated from retard chambers 38 to axial space 114' through oil passages 42R. From axial space 114', the oil is vented through the end of camshaft phaser attachment bolt 68 through retard drillings 120. For clarity, FIG. 7C' is provided without reference numbers and without elements that do not define the oil passages to clearly show the path taken by the pressurized oil represented by arrows P and the path taken by the vented oil represented by arrows V.

While internal combustion engine 10 has been described as having camshaft phaser 12 applied camshaft 14, it should now be understood internal combustion engine 10 may include multiple camshafts that that each camshaft may include its own camshaft phaser. It should also be understood that one camshaft may use a camshaft phaser in accordance with the present invention, while the second camshaft phaser may be another type of camshaft phaser, for example, an electrically actuated camshaft phaser. It should also be understood that the present invention applies to both internal combustion engines with a single bank of cylinders and to internal combustion engines with multiple banks of cylinders.

The operation of camshaft phaser 12 has been described as supplying pressurized oil to retard chambers 38 when actuator 130 is not energized, while at the same time venting oil from advance chambers 36. It should now be understood that operation of camshaft phaser 12 could also be arranged to supply pressurized oil to advance chambers 36 when actuator 130 is not energized, while at the same time venting oil from retard chambers 38. Similarly, the operation of camshaft phaser 12 has been described as supplying pressurized oil to advance chambers 36 when actuator 130 is energized, while at the same time venting oil from retard chambers 38. It should now be understood that the operation of camshaft phaser 12 could also be arranged to supply pressurized oil to retard chambers 38 when actuator 130 is energized, while at the same time venting oil from advance chambers 36.

While this invention has been described in terms of preferred embodiments thereof, it is not intended to be so limited, but rather only to the extent set forth in the claims that follow.

I claim:

1. A camshaft phaser for controllably varying the phase relationship between a crankshaft and a camshaft in an internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator and having a plurality of vanes interspersed with said stator lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attachable to said camshaft of said internal combustion engine to prevent relative rotation between said rotor and said camshaft;

a bushing adaptor coaxially disposable within a pocket of said camshaft and coaxially disposed within said rotor; and a camshaft phaser attachment bolt extending coaxially through said bushing adaptor in a close fitting relationship and threadably engageable into said camshaft to attach said camshaft phaser to said camshaft;

wherein said bushing adaptor defines at least in part:

a supply passage for communicating pressurized oil from said internal combustion engine to a control valve, said supply passage being defined at least in part by a first annular groove formed on the inside surface defining the inside diameter of said bushing adapter;

an advance passage for selectively communicating pressurized oil from said control valve to said advance chambers; and a retard passage for selectively communicating pressurized oil from said control valve to said retard chambers.

2. A camshaft phaser as in claim 1 wherein said supply passage is further defined by an axial groove formed in one of the inside surface of said rotor and a cylindrical sleeve disposed coaxially between said rotor and said bushing adaptor, said axial groove being in fluid communication with said first annular groove through a first connecting passage extending radially through said bushing adaptor.

3. A camshaft phaser as in claim 2 wherein said supply passage is further defined by a second annular groove formed on the inside diameter of said bushing adapter, said second annular groove being in fluid communication with said axial groove through a second connecting passage extending radially through said bushing adaptor.

4. A camshaft phaser as in claim 3 wherein said second annular groove is disposable within said pocket of said camshaft.

5. A camshaft phaser as in claim 3 wherein said supply passage is further defined by a third annular groove formed on the outside diameter of said bushing adapter, said third annular groove being in fluid communication with said axial groove and said second connecting passage.

6. A camshaft phaser as in claim 1 wherein one of said advance passage and said retard passage is defined by a fourth annular groove formed on the inside diameter of said bushing adaptor.

7. A camshaft phaser as in claim 6 wherein the other of said advance passage and said retard passage is defined by an axial space formed between an axial end of said bushing adaptor and said camshaft phaser attachment bolt.

8. A camshaft phaser as in claim 1 wherein said camshaft phaser attachment bolt comprises an axial bore containing said control valve.

9. A camshaft phaser as in claim 8 wherein said camshaft phaser attachment bolt comprises:

a first radial passage therethrough for communicating pressurized oil from said internal combustion engine to said axial bore; and a second radial passage therethrough for communicating pressurized oil from said axial bore to said supply passage of said bushing adaptor.

10. A camshaft phaser as in claim 9 wherein a check valve assembly is disposed between said first radial passage and said second radial passage whereby pressurized oil is allowed to be communicated from said first radial passage to said second radial passage and whereby pressurized oil is substantially prevented from being communicated from said second radial passage to said first radial passage.

11. A camshaft phaser as in claim 10 wherein said check valve assembly comprises:

a framework having first annular ring and a second annular ring spaced axially a and second annular rings spaced axially apart and joined together by a plurality of ribs;

a valve member disposed within said framework to allow pressurized oil to be communicated from said first radial passage to said second radial passage and to substantially prevent pressurized oil from being communicated from said second radial passage to said first radial passage.

12. A camshaft phaser as in claim 11 wherein said plurality of ribs extends radially inward from said first and second annular rings to guide and center said valve member within said framework.

13. A camshaft phaser as in claim 11 wherein a filter is disposed around the entirety of said plurality of ribs to filter contaminants from pressurized oil passing through said check valve assembly from said internal combustion engine to said control valve.

14. A camshaft phaser as in claim 11 wherein said valve member is cup-shaped and an open end of said valve member receives a check valve spring for biasing said valve member toward a position which substantially prevents pressurized oil from being communicated from said second radial passage to said first radial passage.

15. A camshaft phaser as in claim 11 wherein said valve member is cup-shaped and a closed end of said valve member is dome-shaped.

16. A camshaft phaser as in claim 1 wherein said bushing adaptor coaxially aligns said camshaft phaser with said camshaft.

* * * * *